US007678258B2

(12) United States Patent
Andricacos et al.

(10) Patent No.: US 7,678,258 B2
(45) Date of Patent: Mar. 16, 2010

(54) VOID-FREE DAMASCENE COPPER DEPOSITION PROCESS AND MEANS OF MONITORING THEREOF

(75) Inventors: Panayotis Andricacos, Croton-on-Hudson, NY (US); Dean S. Chung, Essex Junction, VT (US); Hariklia Deligianni, Tenafly, NJ (US); James E. Fluegel, Rhinebeck, NY (US); Keith T. Kwietniak, Highlandfalls, NY (US); Peter S. Locke, Hopewell Junction, NY (US); Darryl D. Restaino, Modena, NY (US); Soon-Cheon Seo, White Plains, NY (US); Philippe M. Vereecken, Sleepy Hollow, NY (US); Erick G. Walton, Shelburne, VT (US)

(73) Assignee: International Business Machines Corporation, Armonk, NY (US)

( * ) Notice: Subject to any disclaimer, the term of this patent is extended or adjusted under 35 U.S.C. 154(b) by 1064 days.

(21) Appl. No.: 10/615,794

(22) Filed: Jul. 10, 2003

(65) Prior Publication Data

US 2005/0006242 A1 Jan. 13, 2005

(51) Int. Cl.
*C25D 5/00* (2006.01)

(52) U.S. Cl. ..... 205/81; 205/101

(58) Field of Classification Search ..... 205/81, 205/101

See application file for complete search history.

(56) References Cited

U.S. PATENT DOCUMENTS 5,192,403 A 3/1993 Chang et al.
5,196,096 A 3/1993 Chang et al.
5,352,350 A 10/1994 Andricacos et al.
6,083,374 A * 7/2000 Kopp ..... 205/101
6,113,769 A 9/2000 Uzoh et al.
6,406,608 B1 6/2002 Uzoh et al.
6,471,845 B1 10/2002 Dukovic et al.
6,569,307 B2 * 5/2003 Blachier et al. ..... 205/82
6,592,747 B2 7/2003 Horkans et al.
6,749,739 B2 * 6/2004 Chalyt et al. ..... 205/788.5
6,881,319 B2 * 4/2005 Seita et al. ..... 205/296
2002/0125142 A1 * 9/2002 Sun et al. ..... 205/101
2004/0108213 A1 * 6/2004 Talasek et al. ..... 205/81

OTHER PUBLICATIONS

Skoog, D.A.; West, D. M.; Holler, F.J. Fundamentals of Analytical Chemistry, 7th Ed. Saunders College Publishing, Forth Worth, 1996, pp. 701-703 and 708-709.*

* cited by examiner

*Primary Examiner*—Harry D Wilkins, III
*Assistant Examiner*—Nicholas A. Smith
(74) *Attorney, Agent, or Firm*—Connolly Bove Lodge & Hutz LLP; Louis J. Percello, Esq.

(57) ABSTRACT

An improved method of stabilizing wet chemical baths is disclosed. Typically such baths are used in processes for treating workpieces, for example, plating processes for plating metal onto substrates. In particular, the present invention relates to copper plating baths. More particularly, the present invention relates to the stability of copper plating baths. More particularly, the present invention relates to prevention of void formation by monitoring the accumulation of deleterious by-products in copper plating baths.

11 Claims, 4 Drawing Sheets

VOID-FREE DAMASCENE COPPER DEPOSITION PROCESS AND MEANS OF MONITORING THEREOF

TECHNICAL FIELD

The present invention relates generally to the field of wet chemical baths used in processes for treating workpieces, for example, plating processes for plating metal onto substrates. In particular, the present invention relates to copper plating baths. More particularly, the present invention relates to the stability of copper plating baths. More particularly, the present invention relates to prevention of void formation by monitoring the accumulation of deleterious by-products in copper plating baths.

BACKGROUND

The information provided below is not admitted to be prior art to the present invention, but is provided solely to assist the understanding of the reader.

Chemical baths are solutions, normally but not necessarily aqueous, which contain one or more chemicals, hereinafter called chemical species or species. These chemical species exist in certain concentrations in the solution. Some of these species interact or chemically react with a material, called a workpiece, which is placed in the bath. Examples of such chemical baths or "wet processes" are electroplating, electroless deposition, chemical and electrochemical etching, pickling, adhesion promotion, seeding (deposition of a thin catalytic layer on a workpiece), photographic and lithographic developing, and rinsing. Most of these baths interact with the workpiece to produce changes in the workpiece surface, e.g., addition of a film on the workpiece surface or removal of some or all of the initial workpiece surface.

Plating baths, and especially copper plating baths, are described in co-pending application Ser. No. 09/881,817 (allowed Feb. 24, 2003, patent number not yet assigned), the contents of which are hereby incorporated by reference and for all purposes.

While the chemical bath and the workpiece are interacting, both the bath and the workpiece change. Chemical species may leave the bath, i.e., the species is depleted from the bath, to deposit or plate on to the workpiece. Alternatively, a chemical species may be removed (e.g. etched) from the workpiece and enter, or accumulate in the bath. As the bath changes due to the accumulation and/or depletion of these and other species, the bath is said to "age."

Copper interconnects are widely used for integrated circuits and semiconductor chip structures. The on-chip interconnect lines and vias are formed by single or dual Damascene copper electroplating from an electroplating, or electroless plating, bath. Modern devices are being designed with finer features having larger aspect ratios. Plating such structures using traditional plating baths often results in the formation of voids. Complete fill of the line and via structures is crucial for good electrical performance of the devices. Additives, are compounds added to the plating solution to give the bath so called "superfilling" properties which enable void-free plating of these small features. Two or three organic additive components are commonly used in copper plating chemistries for the microelectronics industry, an accelerator (e.g. sulfide type SPS, (bis-sulfopropyl disulfide)), a suppressor (e.g. PEG type polymer) and a leveler (added when a flat surface is required as an end-product).

Bath metrology techniques such as cyclic voltammetry stripping (CVS) or potentiometric techniques measure and control the concentration of the additive components in electroplating baths. Within a proper concentration range, the combination of these additives results in superfilling of moderate to high aspect ratio vias and trenches. "Superfilling," also known as "superconformal" or "bottom-up filling," refers to a process in which the plating rate in a feature, such as a trench or a via, is greater that the plating rate in the plane of the field of the wafer surface. The required differential plating kinetics are obtained by appropriate addition, to the bath, of additives that either inhibit plating in the field or catalyze plating in a feature. During the copper plating process and also during idle periods in between plating, these additives are known to be consumed electrochemically and chemically at the cathode as well as at the anode, bringing reaction products, or so-called byproducts into the solution. While the leached additives are replenished with the help of the bath metrology techniques described above, the byproducts are building up in the solution. This process is known as bath aging. Some of the byproducts will interfere with the superfilling mechanism and as a result may cause voids in the plated copper. Bath exchange or "bleed and feed" is commonly used to keep the byproducts at relatively low concentrations and to obtain steady state conditions. However, the novel copper plating chemistries developed for superfilling of sub micron features are accelerator/suppressor dominated systems as opposed to leveler dominated baths. The rapid gap fill kinetics characteristic for these bath chemistries are capable of filling high aspect ratio submicron features. However gap fill kinetics are very sensitive to accelerator byproducts in solution. Typically the gap fill deteriorates when the byproducts build up in solution. At a certain byproduct concentration the bath will no longer be able to fill small features successfully and plating voids are obtained. This breakdown point depends on the aggressiveness of the trenches and vias (feature size, aspect ratio and shape) and on the concentration of the accelerator. The sulfide type accelerator is the most easily consumed component, both under working as well as under idle conditions. In order to maintain a stable, functional bath it is important to have a technique which can measure the byproducts quantitatively or relative to the accelerator concentration. In this way the bath can be controlled so that by-product levels are kept below the breakdown point or bath threshold for voiding.

The invention comprises a universal method to quantitatively monitor the chemistry of plating baths for by-product levels during bath aging and to eliminate voids in the plated deposit by keeping the by-product levels within a well determined acceptable range. Most commercial available copper plating chemistries (e.g. Enthone-OMI and Shipley Company) contain SPS or an SPS-type sulfide as an accelerator (brightener) in their organic additive package. During the copper plating process and also during idle periods in-between plating the SPS accelerator is consumed and reaction products or so-called by-products are formed. The depleted additives are replenished with the help of the conventional bath metrology techniques. However, the concentration of by-products in solution continues to increase. This process is known as bath aging. High by-product concentrations, particularly in relation to the accelerator concentration, may result into plating voids. Bath exchange or "bleed and feed" is commonly used to keep the by-products at a low steady state concentration.

The copper plating chemistries developed for superfilling of submicron patterns (e.g. Viaform from Enthone OMI and Ultrafill or Nanoplate from Shipley Company) operate with relatively low accelerator concentrations compared to their predecessor formulations. Therefore, as the plating bath ages, the relative concentration of by-products with time may become large as compared to the accelerator concentration. We have observed that increasing ratios of by-product to accelerator concentrations are associated with an increased formation of plating voids.

A method is required to monitor the ratio of by-product concentration to accelerator concentration and thereby to permit appropriate intervention to decrease or prevent void formation.

Other objects and advantages will become apparent from the following disclosure.

SUMMARY OF THE INVENTION

The present invention provides a void-formation marker, an observable parameter of a plating bath that is predictive of the probability of forming voids in a copper plating applied to a substrate operated on by the bath.

The present invention provides a means of achieving void-free plating or substantially void-free plating by permitting the determination of an acceptable range of by-products in a plating bath.

The present invention provides that high performance liquid chromatography (HPLC) is used as a technique for quantitatively monitoring the ratio of by-products to accelerator concentration. The proposed method of invention is to correlate the by-product to accelerator concentration with void formation in plated patterns and to determine the acceptable range for by-products to build up in the plating bath. In this way void-free plating can be achieved by quantitatively monitoring the by-product levels in the plating bath with, HPLC and by keeping the by-product to accelerator ratio within an acceptable range.

The present invention provides a method of measuring a stability of a plating bath, said method comprising the steps of: providing means of monitoring a void-formation marker; providing a plating bath liquor, possibly containing said void-formation marker, to said monitoring means; and monitoring said void-formation marker.

The present invention provides a plating bath threshold value. The present invention provides that void-free plating may be achieved by maintaining the level of a void-formation marker below an empirically-determinable threshold value. When the concentration ratio of a void-formation marker to accelerator is below a threshold value, the probability of forming voids is low. The threshold value is a function of the bath chemistry and geometry and the architecture of the substrate intended to be plated.

The present invention provides a method of measuring a plating bath breakdown threshold value, which comprises providing a plating bath; providing a substrate, the substrate personalized with features defined thereon to be plated; providing means of monitoring a void-formation marker (VFM); providing means of monitoring an accelerator; operating said bath to plate a metal on said substrate; determining a void density in the metal plated on said substrate; providing a bath liquor from said plating bath, containing a concentration of an accelerator and possibly containing a concentration of said void-formation marker, to said monitoring means; determining a concentration of said void-formation marker and of said accelerator; determining a VFM ratio; and relating said void density to said VFM ratio.

A working plating bath is operated in such manner as to maintain the accelerator concentration fixed within a defined tolerance. The present invention uses this observation to provide that the absolute measured value of the by-products (i.e. the integrated area under the product peaks) can be used as a monitor of void formation.

Still other objects and advantages of the present invention will become readily apparent by those skilled in the art from the following detailed description, wherein it is shown and described preferred embodiments of the invention, simply by way of illustration of the best mode contemplated of carrying out the invention. As will be realized the invention is capable of other and different embodiments, and its several details are capable of modifications in various obvious respects, without departing from the invention. Accordingly, the description is to be regarded as illustrative in nature and not as restrictive.

DETAILED DESCRIPTION OF A PREFERRED EMBODIMENT

Reference is made to the figures to illustrate selected embodiments and preferred modes of carrying out the invention. It is to be understood that the invention is not hereby limited to those aspects depicted in the figures.

Figure 1:
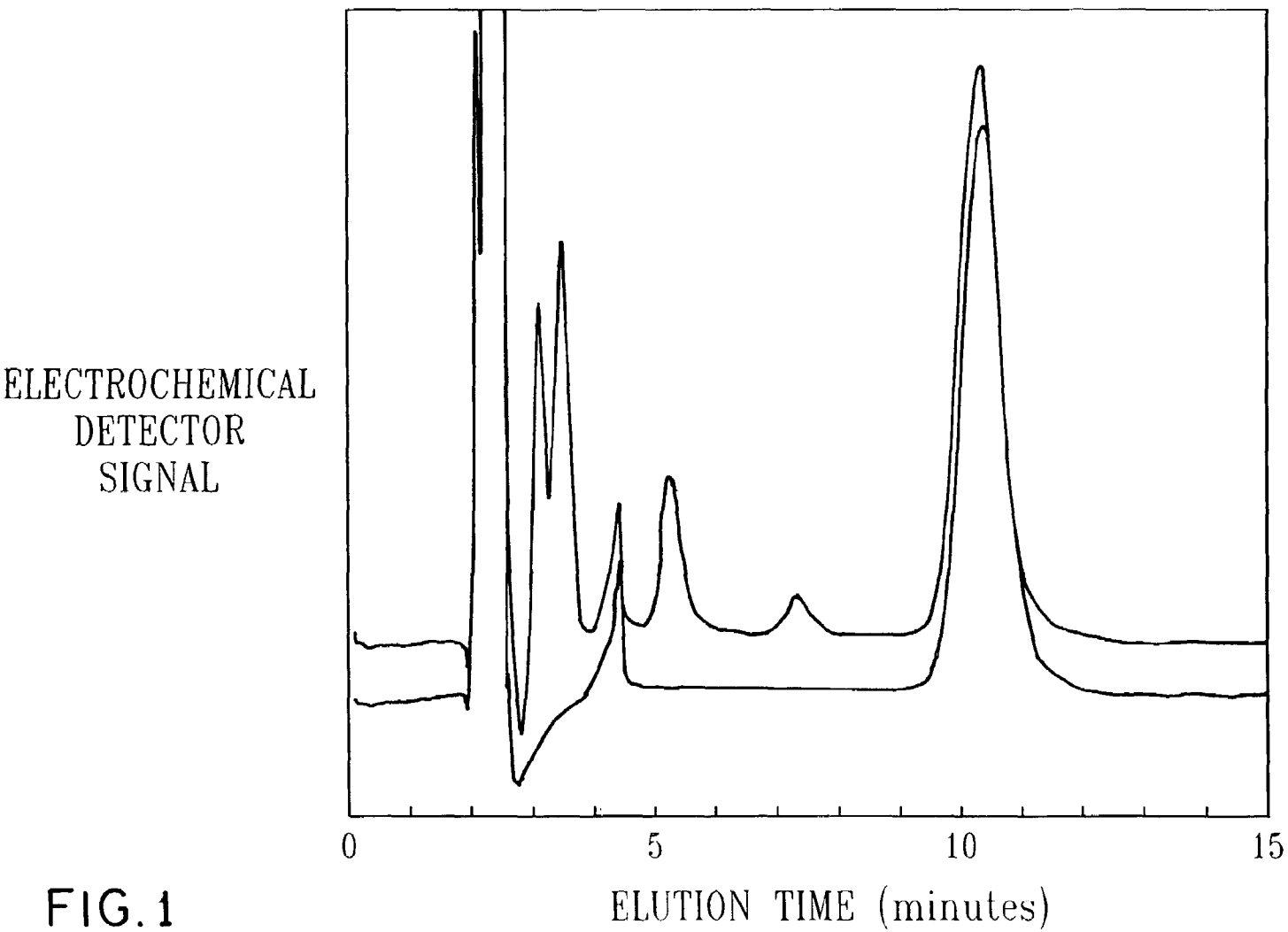
FIG. 1 shows a typical HPLC chromatogram for a fresh copper plating bath and for a similar bath aged for three weeks.

FIG. 1 shows typical HPLC chromatograms for a freshly made copper plating bath (red) (Viaform. Enthone-OMI) and a bath which had aged for 3 weeks with a 10% bath exchange (blue). Components of the liquor from the various baths were resolved by HPLC chromatography. Aliquots of bath liquor were resolved by ion-pairing chromatography on a 4 by 250 mm NS1 column (Dionex, Sunnyvale, Calif.) eluted with 0.1N sulfuric acid in 5% (v/v) acetonitrile at a flow rate of 1 ml/min. The column effluent was passed through an electrochemical detector. Sulphur-containing species where measured as the charge at a gold electrode (1.05V vs Ag/AgCl reference electrode, integration time of 200 ms). The waveform applied for detection was 1.05V for 0.5 s and the charge was measured during the last 0.2 s. Following a measurement, the electrode was conditioned by applying a potential of 0.5V for 0.12 s and 0.01V for 0.22 s. The peak at 10 minutes is due to the elution of SPS of the column and the charge under the peaks in both chromatograms corresponds to 4 mg/l of SPS. In the aged bath up to four additional peaks can be detected with the electrochemical detector.

Electrochemical detection is a quantitative technique. The area under a peak may be mathematically related to the concentration of a chemical species in solution. Alternatively, the area under a peak may be standardized against defined quantities of a known chemical species. In FIG. 1, the accelerator concentration is determined quantitatively by comparison with standards, and this technique then provides an accurate way for direct measurement and control of the accelerator concentration in the bath.

In the aged bath up to four peaks, in addition to the SPS peak at 10 minutes, can be detected with the electrochemical detector. The first two by-products elute around the same time (3 and 3.5 minutes) are low molecular weight molecules attributed to oxidized forms of MPS (mercapto propane sulfonic acid, the reduced thiol monomer of the SPS disulfide molecule). By-products eluting at about 5 and 7 minutes are attributed to different oxidized forms of the SPS disulfide molecule. By-product 3, which elutes at 5.2 minutes, is not to be confused with MPS itself, which elutes around the same time and may be present in a plating bath in the form of Cu(I)sulfopropyl thiolate. This complex is only short living and will only be detected in samples directly taken from the plating bowl and measured immediately after a plating run.

Void-Formation Marker. It is believed that by-product 3 is responsible for the formation of plating voids. According to the present invention, the peak at about 5.2 minutes is a void-formation marker because the ratio of the area of the 5.2-minute peak to the 10-minute (accelerator) peak may be correlated with a tendency of a plating bath to yield voids when acting on a substrate to be plated. Although it is believed that an oxidation product of Cu(I)sulfopropyl thiolate is the chemical species responsible for the peak at 5.2 minutes, the invention in no way depends on an accurate identification of the chemical species associated with a particular peak. Any peak that may be empirically, and quantitatively, associated with a probability of void formation, is a void-formation marker (VFM) according to the present invention.

An embodiment of the present invention provides that instead of monitoring a single by-product peak, a probability of forming voids may be associated with total by-product formation. Total by-product formation may be quantified as the total integrated area under all by-product peaks.

An embodiment of the present invention provides for monitoring a void-formation-marker without monitoring an accelerator concentration. Plating baths are operated such that the accelerator concentration is maintained within a per-established tolerance of a known target value. Therefore, merely monitoring a level of a void-formation-marker will permit the determination of a probability of developing voids during the operation of the bath. Because the accelerator concentration is maintained at a constant value (±a known tolerance), an embodiment of the present invention provides for monitoring a VFM by a technique insensitive to the presence of accelerator.

Chromatography. The present invention requires a means to separate a void-formation marker from an accelerator. In a preferred embodiment, the separation means comprise liquid chromatography. In a preferred embodiment of the invention, the chromatography is column chromatography. In a preferred embodiment, the separation is performed by high performance liquid chromatography (HPLC). In a preferred embodiment the separation is performed by ion-pairing chromatography over an ethylvinylbenzene/divinylbenzene reversed-phase column. A suitable reversed-phase column is an IonPac NS1 (® Dionex, Sunnyvale, Calif.). In a preferred embodiment, the ion-pairing solvent is 0.1N sulfuric acid in 5% (v/v) acetonitrile. Other ion-paring solvents and reversed-phase columns are known to the art. Persons of skill in the chromatographic arts may readily suitable chromatographic conditions. Although a preferred mode is discussed above, the present invention encompasses any chromatographic method that is capable of separating a VFM. Persons of skill will recognize that the various components of an aged plating bath may be separated by a variety of chromatographic systems. Moreover, persons of skill will recognize that any such chromatographic system that separates a void-formation marker from an accelerator is suitable for purposes of the present invention.

The separation means of the present invention are not limited to the specific chromatographic conditions of FIG. 1. Furthermore, persons of skill recognize that the time at which any chemical species elutes from a chromatography column (the elution time) is a sensitive function of the precise conditions, including: column geometry, resin, elution solution, and fluid, among other variables. The present invention does not depend on a peak having a specific elution time. Rather, the invention requires the ability to separate, identify, and quantitate a void-formation marker peak and an accelerator peak Spectroscopy. The detection means may be spectroscopic means based on the absorption of light. As is known to persons of skill, where light of a given wavelength and having an intensity, $I_0$, is incident on a solution of an absorbing chemical species, and the intensity, $I_t$, of the transmitted light is measured, the absorbancy, A, ($A=\log I_0/I_t$) is quantitatively related to the solution concentration of the absorbing species.

The detection means may be quantitative means. Quantitative means provide a mathematical relationship between the concentration of a species in solution and an observable parameter sensitive to the presence of the solvated species. For purposes of the present invention, a relevant species is a void-formation marker. Where the detection means are spectroscopic means, a quantitative relationship is described by Beer's Law ($A=\epsilon cl$). Where the extinction coefficient, $\epsilon$, is given in molar units, a molar concentration (moles of solvated chemical species per liter of solution) may be determined by applying Beer's Law to an observed molar absorbancy. In this case the molar absorbancy is an observable parameter sensitive to the presence of a relevant species, the void-formation marker. A Beer's Law relationship allows a detection means to be a quantitative detection means. Electrochemical detection is also a quantitative technique. For simple charge transfer reactions the electrochemical response is proportional to the concentration. However, for more complex charge transfer reactions, for example when adsorption is involved in the mechanism (such as for SPS and its oxidation products), the response is ill-determined and a polynomial best fit is necessary. Quantitation is achieved by using a minimum of three standard known concentrations to construct a calibration curve. In an embodiment, a VFM is separated and quantified by mass spectroscopy.

Figure 2A:
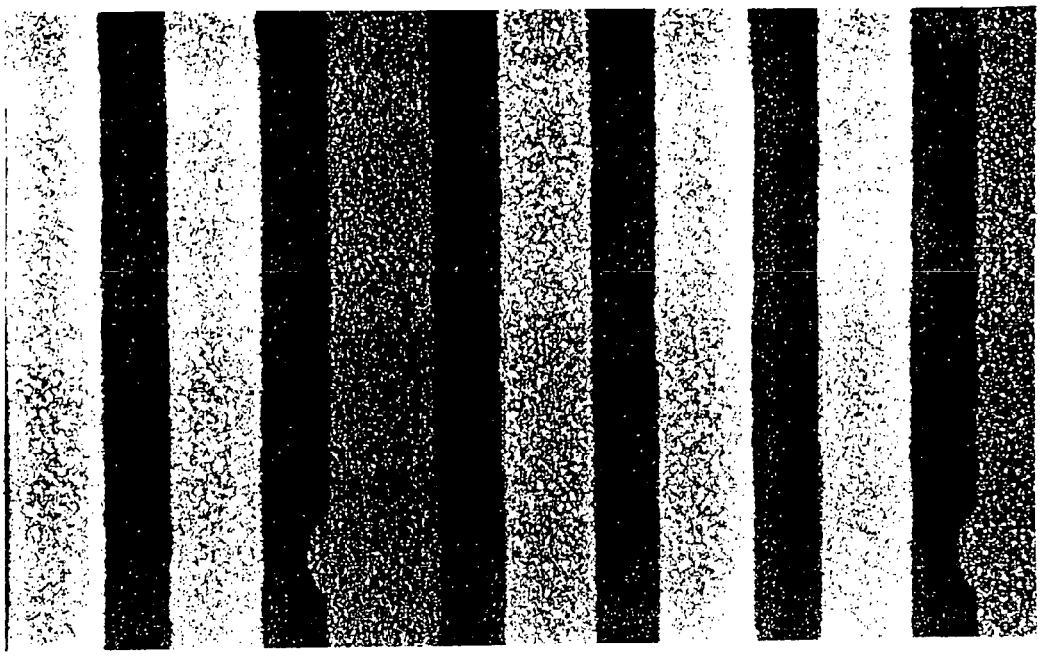
FIG. 2*a* shows a top-down SEM image of 0.18 μm lines, plated from a freshly-made bath, post CMP.
Figure 2B:
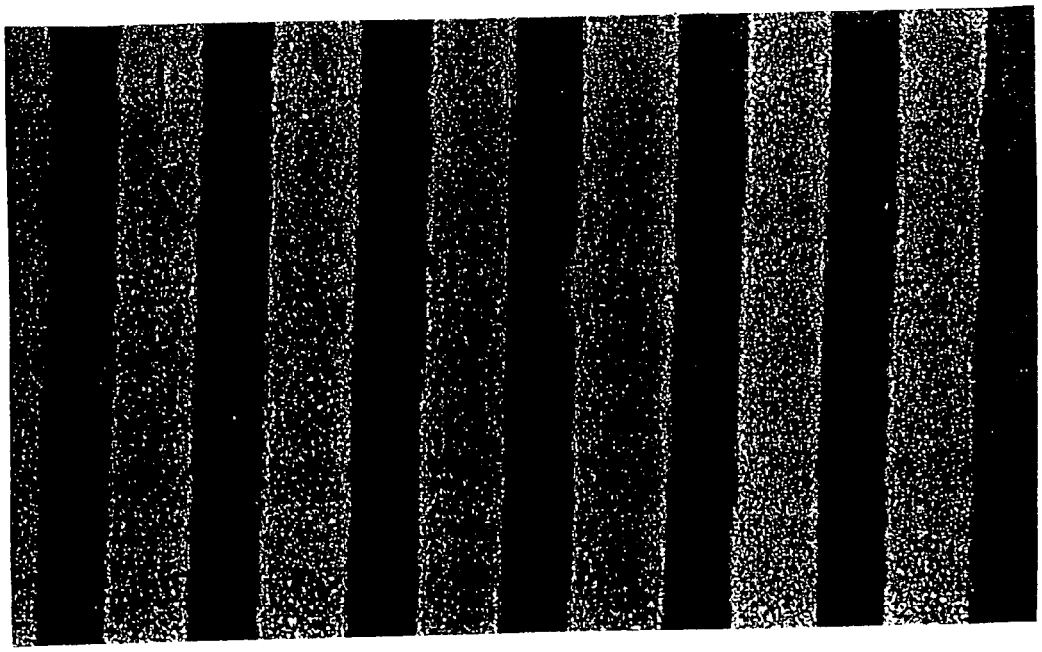
FIG. 2*b* shows a top-down SEM image of 0.18 μm lines, plated from an aged bath, post CMP.

FIGS. 2*a* and *b* show top-down SEM images of 0.18 um lines after CMP plated from a freshly made and an aged bath, respectively. The relative area under the two main by-product peaks with respect to SPS was 42% (by-product 3, from SPS oxidation product) and 26% (by-product 2, from SPS oxidation products) for the aged bath. Inspection of the figures shows copper lines, free of voids, for a fresh bath and voided lines, in the case of an aged bath. In this example, the ratio of VFM concentration to accelerator concentration was 16%, more than double the threshold for voiding.

Figure 3:
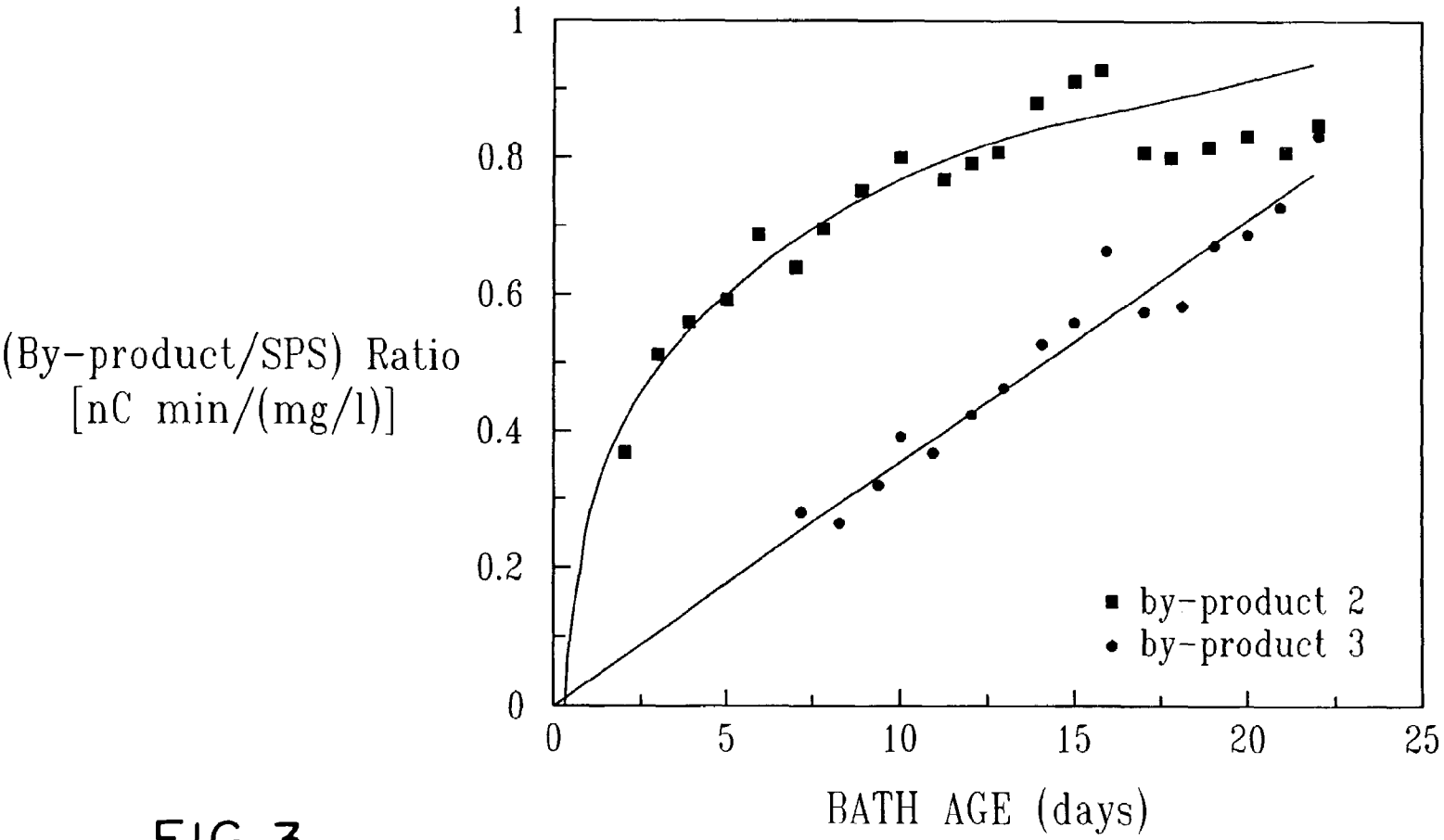
FIG. 3 shows increase in by-product ratios as a function of time.

FIG. 3 shows the by-product to SPS ratio for by-products 1 and 2, combined, and for by-product 3, followed with HPLC during 3 weeks aging of a Viaform bath. A 10% daily bath exchange protocol was followed to maintain a relatively constant accelerator level of about 4 mg/l SPS. The concentration of the by-products was measured by electrochemical means and quantified as the area under the peaks (nanoCoulombs minutes). By-products 1 and 2 reach a steady state value after about 10 days. In contrast, the concentration of by-product 3 increases linearly with time.

Figure 4:
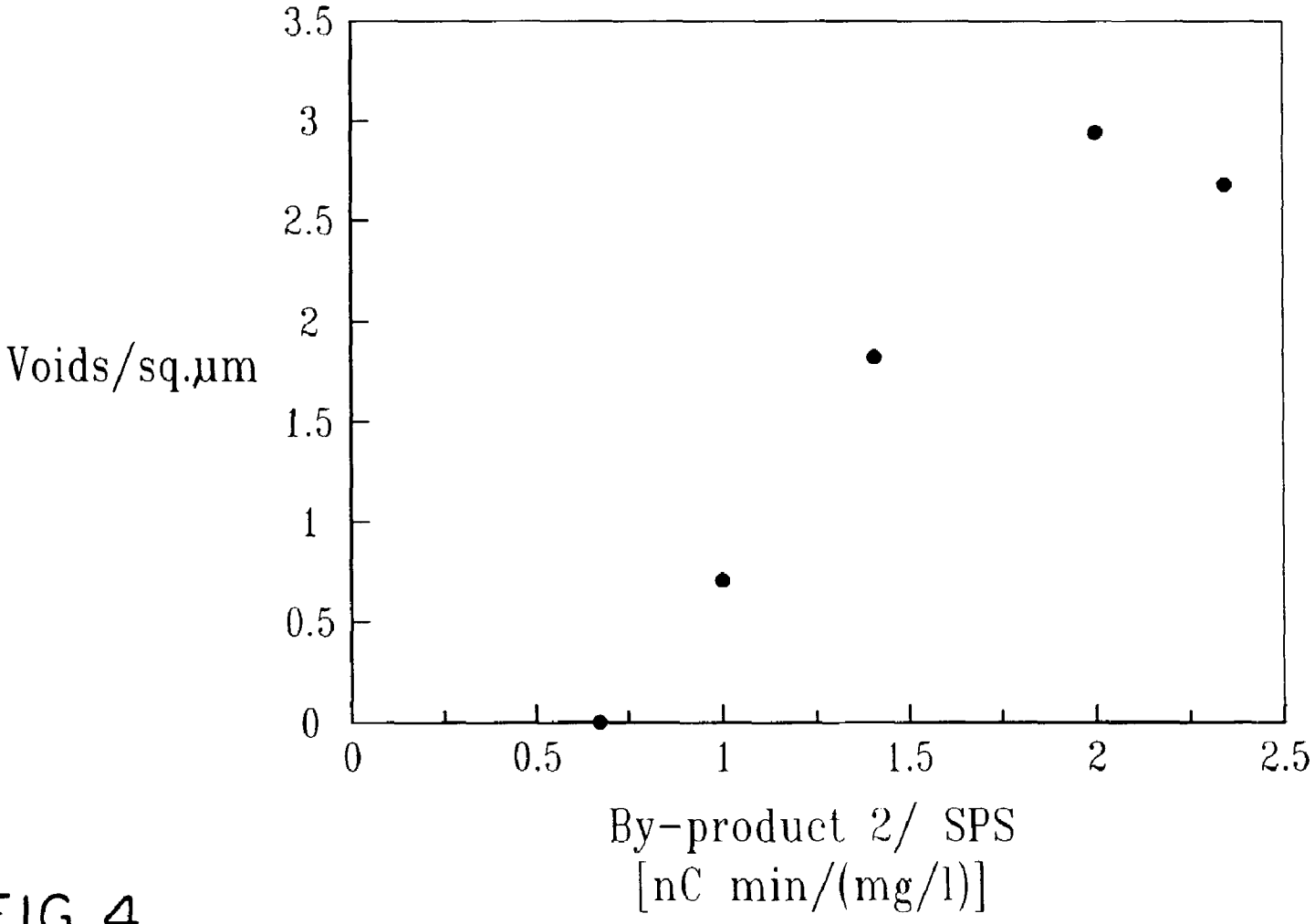
FIG. 4 shows the average number density of voids formed in a maze of 0.18 micron wide lines versus the ratio of peak area for a void-formation marker; and It is to be noted, however, that the appended drawings illustrate only typical embodiments of this invention and are therefore not to be considered limiting of its scope, for the invention may admit to other equally effective embodiments.

Plating bath breakdown threshold value. FIG. 4 shows the average number of voids in a trench maze of 0.18 micron wide lines with a 0.3 micron pitch versus the ratio of the peak area (nanoCoulombs minutes) for by-product 3with respect to the SPS concentration (mg/l). The data points were obtained from wafers plated from two aged Viaform baths (4 mg/l SPS). One bath was then diluted to decrease the SPS concentration and subsequently spiked with SPS to increase the SPS concentration. The data suggest that in order to achieve void-free plating of 9S M1 lines the level of by-product 3 needs to be below 0.7 nC minutes per mg/l SPS in the bath. FIG. 4 defines a breakdown threshold value for the system defined by the given bath and the given plating substrate (trench maze). For the system defined in FIG. 4, 0.7 nC minutes by-product 3 per mg/l SPS is a breakdown threshold value. Where by-product 3 is present a levels lower than the threshold value, no voids are observed. However, the density of voids (number of voids per square micrometer) increases linearly with by-product 3 concentration above the threshold level.

A patterned plating substrate is a workpiece, or maze having a pattern of lines, vias, and/or other features defined thereon to be built up by a deposition of metal from a plating bath. In other words, a maze or workpiece, is defined as a substrate suitable to be plated by a plating bath and personalized by having a defined pattern of features capable of being built up by being plated by at least one metal from the plating bath. The threshold value is a function of the geometry of the features to be plated on the target substrate. The present invention provides an ability to determine a threshold value for a given geometry by varying the substrate plated in a given bath.

The present invention provides measuring a plating bath breakdown threshold value using a maze representative of the substrates to be plated during a production run. In a first step a plating bath, representative of a bath to be used during a production run is provided. The bath typically has a concentration of accelerator. Typically, the value of the accelerator concentration is known, or is readily determinable. Typically, the bath is permitted to operate so as to plate at least some quantity of at least one metal on the maze.

Typically, operating the bath generates a concentration of at least one by-product. Typically, this at least one by-product is a void-formation marker (VFM). Under the conditions of FIG. 1, the VFM typically elutes at about 5.2 minutes.

Typically, operating the bath plates at least a quantity of at least one metal on the plating substrate. In a fresh bath, and in a bath wherein a VFM is maintained below a threshold value, the plated features will be void-free. When the level of a VFM increases to above a threshold value, voiding will be observed. The present invention provides that the number of voids incorporated during the plating process may be counted. A preferred means of counting voids is by scanning electron microscopy (SEM). A void density ($D_v$) may be determined by dividing the number of voids incorporated into the maze by the area of the maze.

A further step in the preferred method of determining a plating bath threshold value is to relate the VFM concentration ($C_{VFM}$) to the accelerator concentration ($C_A$). The present invention provides means of monitoring a void-formation marker. The monitoring means comprise means of separating the VFM from the accelerator and means of detecting the VFM and the accelerator. Chromatography is an acceptable separation means. Liquid chromatography is a preferred separation means. HPLC is a more preferred separation means. Spectroscopy is a detection means. Electrochemical detection is a preferred means. Typically, adequate separation is denoted by the appearance of at least two peaks on a chromatogram; a first peak, representing accelerator; and a second peak representing VFM.

Typically, a bath liquor, containing a concentration of accelerator, and possibly containing a concentration of VFM is provided to the monitoring means. Typically, the monitoring means output a chromatogram comprising first and second peaks as recited above. In a preferred embodiment of the present invention, the area of a peak is proportional to the concentration of the chemical species detected. In a preferred embodiment, $C_{VFM}$ is determined from the area of the VFM peak. In FIG. 1, the VFM peak elutes at about 5.2 minutes.

Typically, a VFM ratio ($R_{VFM}$) is determined as the area of the VFM peak divided by the area of the accelerator peak. Alternatively, absolute measured concentrations may be used instead of relative areas. $R_{VFM}$ is the ratio of the concentrations of the two species.

FIG. 4 relates the void density, $D_V$, to the VFM ratio, $R_{VFM}$, determined for a 0.18 micron trench maze plated from a Viaform bath. The figure shows that $D_V$ increases linearly with increasing $R_{VFM}$, until the process apparently saturates. Moreover, the Figure defines a threshold, T, about 0.7 nC minutes per mg/l, below which voids are apparently not formed in the maze. FIG. 5 shows the void density increases exponentially as a function of the normalized VFM concentration. The normalized VFM concentration is $C_{VFM}/T$.

The threshold value, T, is also a function of the bath chemistry. The present invention provides determining a threshold value for each various bath chemistry.

An embodiment of the present invention provides for maintaining a VFM concentration below the threshold concentration. The threshold value is determined for a given bath and the VFM concentration is determined. The fraction of the volume of plating bath liquor that must be exchanged for fresh plating bath liquor so as to maintain the VFM concentration below the threshold concentration is determined. A "bleed and feed" is performed to reduce the VFM concentration appropriately. Typically, a bleed and feed is performed by adding fresh bath liquor to a fractional volume above the nominal bath volume and removing a volume of liquid equal to the fractional volume. Typically, the fractional volume is from about 1% to about 10% of the nominal bath volume. Typically, the fractional volume depends on the ageing characteristics and the threshold value of the bath.

Although the illustrative embodiments of the invention are drawn from the semiconductor arts, the invention is not intrinsically limited to that art.

Furthermore, it is to be understood that the form of the invention shown and described is to be taken as presently preferred embodiments. Various modifications and changes may be made to each and every processing step as would be obvious to a person skilled in the art having the benefit of this disclosure. It is intended that the following claims be interpreted to embrace all such modifications and changes and, accordingly, the specification and drawings are to be regarded in an illustrative rather than a restrictive sense. Moreover, it is intended that the appended claims be construed to include alternative embodiments.

INCORPORATION BY REFERENCE

All publications and patent applications cited in this specification are herein incorporated by reference, and for any and all purposes, as if each individual publication or patent application were specifically and individually indicated to be incorporated by reference.

Having thus described our invention, what we claim as new, and desire to secure by Letters Patent is:

1. A method of operating a plating bath comprising:

providing a plating bath containing at least an accelerator;

plating at least one metal on a substrate;

measuring the bath concentration of at least one accelerator breakdown product ("void-formation marker, VFM");

measuring the bath concentration of said at least an accelerator;

determining a VFM ratio at each of a plurality of time-points, wherein said VFM ratio is the concentration of said VFM divided by the concentration of said accelerator;

counting, for each of said time-points, the number of voids in the metal plated on said substrate;

determining a VFM threshold ratio as the highest VFM ratio at which no voids are observed; and maintaining said VFM ratio below said VFM threshold ratio by performing a bleed and feed of said plating bath to maintain said VFM ratio below said threshold VFM ratio.

2. The method of operating a plating bath, according to claim 1, wherein determining a concentration of said VFM comprises:

separating said VFM from said plating bath liquor; and quantifying said VFM.

3. The method of operating a plating bath, according to claim 2, wherein said VFM is separated chromatographically.

4. The method of operating a plating bath, according to claim 3, wherein said VFM is separated by liquid chromatography.

5. The method of operating a plating bath, according to claim 3, wherein said VFM is separated by high performance liquid chromatography (HPLC).

6. The method of operating a plating bath, according to claim 3, wherein said chromatography comprises ion-pairing, reversed-phase chromatography.

7. The method of operating a plating bath, according to claim 2, wherein said quantifying is performed by instrumental analytical methods selected from the group consisting of spectroscopy and electrochemical detection.

8. The method of operating a plating bath, according to claim 7, wherein said spectroscopy comprises techniques selected from the group consisting of ultraviolet, visible, infrared, and mass spectroscopy.

9. The method of operating a plating bath, according to claim 2, wherein said quantitation is provided by instrumentation that provides a quantitative output in proportion to a concentration of said VFM.

10. The method of operating a plating bath, according to claim 1, wherein said bleed and feed comprises adding a volume of fresh bath liquor to bring the volume above a nominal bath volume and removing said fractional volume.

11. The method of operating a plating bath, according to claim 1, wherein said fractional volume is from about 1% to about 10%.

* * * * *